US010308046B2

(12) United States Patent
Okumura

(10) Patent No.: US 10,308,046 B2
(45) Date of Patent: Jun. 4, 2019

(54) LIQUID EJECTION APPARATUS

(71) Applicant: BROTHER KOGYO KABUSHIKI KAISHA, Nagoya-shi, Aichi-ken (JP)

(72) Inventor: Masayuki Okumura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/869,307

(22) Filed: Jan. 12, 2018

(65) Prior Publication Data

US 2018/0201031 A1 Jul. 19, 2018

(30) Foreign Application Priority Data

Jan. 17, 2017 (JP) ..... 2017-005568

(51) Int. Cl.
*B41J 11/00* (2006.01)
*B41J 2/145* (2006.01)
(Continued)

(52) U.S. Cl.
CPC ..... *B41J 11/007* (2013.01); *B41J 2/145* (2013.01); *B41J 13/0009* (2013.01); *B41J 13/02* (2013.01);
(Continued)

(58) Field of Classification Search
CPC ..... B41J 11/007; B41J 13/03; B41J 13/0009; B41J 13/02; B41J 2/145; B65H 85/00; B65H 29/70; B65H 29/125; B65H 5/062; B65H 3/06; B65H 1/04; B65H 2801/15; B65H 2301/5122; B65H 2301/33312; B65H 2402/32; B65H 2404/133; B65H 2404/1115; B65H 2515/30; B65H 2801/12; B65H 2513/104; B65H 2404/143;
(Continued)

(56) References Cited

U.S. PATENT DOCUMENTS

2011/0291347 A1 12/2011 Sano et al.
2014/0063108 A1* 3/2014 Iijima ..... B41J 13/0009 347/16

FOREIGN PATENT DOCUMENTS

JP 2000-78348 A 3/2000
JP 2009-263140 A 11/2009
(Continued)

OTHER PUBLICATIONS

IP.com search (Year: 2019).*

*Primary Examiner* — Lisa Solomon
(74) *Attorney, Agent, or Firm* — Merchant & Gould P.C.

(57) ABSTRACT

A liquid ejection apparatus, including: a conveyor; and an ejector to eject a liquid; wherein each of an upstream roller pair, a first downstream roller pair, and a second downstream roller pair of the conveyor includes upper and lower rollers to respectively contact front and back surfaces of a recording medium, at least one of the upper and lower rollers being configured to give a conveyance force to the recording medium, wherein a rotation speed of the second downstream roller pair is higher than that of the first downstream roller pair, and the conveyance force of the first downstream roller pair is larger than that of the second downstream roller pair, and wherein the conveyance force of the second downstream roller pair is largest at a position thereof in the first direction which is nearest to the central position of the second downstream roller pair.

15 Claims, 5 Drawing Sheets

(51) Int. Cl.

| | |
|---|---|
| ***B41J 13/02*** | (2006.01) |
| ***B65H 5/06*** | (2006.01) |
| ***B65H 1/04*** | (2006.01) |
| ***B65H 3/06*** | (2006.01) |
| ***B41J 13/00*** | (2006.01) |
| ***B41J 13/03*** | (2006.01) |
| ***B65H 29/12*** | (2006.01) |
| ***B65H 29/70*** | (2006.01) |
| ***B65H 85/00*** | (2006.01) |

(52) U.S. Cl.

CPC ..... *B41J 13/03* (2013.01); *B65H 1/04* (2013.01); *B65H 3/06* (2013.01); *B65H 5/062* (2013.01); *B65H 29/125* (2013.01); *B65H 29/70* (2013.01); *B65H 85/00* (2013.01); *B65H 2301/33312* (2013.01); *B65H 2301/5122* (2013.01); *B65H 2402/32* (2013.01); *B65H 2404/1115* (2013.01); *B65H 2404/133* (2013.01); *B65H 2404/1341* (2013.01); *B65H 2404/143* (2013.01); *B65H 2404/1451* (2013.01); *B65H 2513/104* (2013.01); *B65H 2515/30* (2013.01); *B65H 2801/03* (2013.01); *B65H 2801/12* (2013.01); *B65H 2801/15* (2013.01)

(58) Field of Classification Search

CPC .... B65H 2404/1341; B65H 2404/1451; B65H 2801/03

See application file for complete search history.

(56) References Cited

FOREIGN PATENT DOCUMENTS

| | | | |
|---|---|---|---|
| JP | 2010-149976 | A | 7/2010 |
| JP | 2011-245835 | A | 12/2011 |
| JP | 2012-82036 | A | 4/2012 |

* cited by examiner

LIQUID EJECTION APPARATUS

CROSS REFERENCE TO RELATED APPLICATION

The present application claims priority from Japanese Patent Application No. 2017-005568, which was filed on Jan. 17, 2017, the disclosure of which is herein incorporated by reference in its entirety.

BACKGROUND

Technical Field

The following disclosure relates to a liquid ejection apparatus including a conveyor configured to convey a recording medium and an ejector including a plurality of ejection openings from which a liquid is ejected to the recording medium.

Description of Related Art

There is known an image recording apparatus which includes a conveyor including: a conveyance roller pair (upstream roller pair) disposed upstream of a recording head (ejector) in a conveyance path; a discharge roller pair (first downstream roller pair) disposed downstream of the recording head in the conveyance path; and a switchback roller pair (second downstream roller pair) disposed downstream of the discharge roller pair in the conveyance path. An upper roller of each of the discharge roller pair and the switchback roller pair that is to contact a front surface of the recording medium (i.e., a surface of the recording medium on which the liquid is ejected) is a spur roller having at least one protrusion formed on its outer circumferential surface. This configuration prevents a liquid landed on the front surface of the recording medium from being transferred to the upper roller.

SUMMARY

In the structure in which the recording medium is conveyed using the three roller pairs (i.e., the upstream roller pair, the first downstream roller pair, and the second downstream roller pair), when the recording medium is conveyed by the first downstream roller pair and the second downstream roller pair in a state in which a trailing end of the recording medium passes through the upstream roller pair while it does not yet pass through an ejection region of the ejector located below the recording head, it is required to stabilize conveyance of the recording medium for ensuring a good recording quality. To this end, the first downstream roller pair and the second downstream roller pair are configured to have mutually different rotation speeds or mutually different conveyance forces, especially, mutually different nipping forces for nipping the recording medium by the upper roller and a lower roller, for instance. Specifically, the rotation speed of the second downstream roller pair is made larger than the rotation speed of the first downstream roller pair, and the conveyance force of the first downstream roller pair is made sufficiently larger (e.g., ten times larger) than the conveyance force of the second downstream roller pair. With this configuration, the recording medium slips between the rollers of the second downstream roller pair, so that the first downstream roller pair mainly conveys the recording medium, achieving stable conveyance of the recording medium.

The conveyance force of the first downstream roller pair needs to be made sufficiently larger than the conveyance force of the second downstream roller pair from the viewpoint of ensuring a good recording quality while it is desirable not to increase the conveyance force of the first downstream roller pair too much from the viewpoint of preventing a damage of the recording medium due to pressing by the at least one protrusion of the spur roller. On the other hand, if the conveyance force of the second downstream roller pair is made excessively small, the recording medium slips when the recording medium is conveyed only by the second downstream roller pair, causing a risk that the recording medium fails to be conveyed. Thus, it is difficult to make the conveyance force of the first downstream roller pair sufficiently larger than the conveyance force of the second downstream roller pair. Accordingly, when the recording medium is conveyed by the first downstream roller pair and the second downstream roller pair, the recording medium cannot be stably conveyed, causing a risk of skewing of the recording medium.

Accordingly, one aspect of the present disclosure relates to a liquid ejection apparatus capable of ensuring stable conveyance of the recording medium and preventing skewing of the recording medium when the recording medium is conveyed by the first downstream roller pair and the second downstream roller pair upper rollers of which are spur rollers.

In one aspect of the present disclosure, a liquid ejection apparatus including: a conveyor configured to convey a recording medium along a conveyance path; and an ejector including a plurality of ejection openings from which a liquid is ejected to a front surface of the recording medium conveyed by the conveyor; wherein the conveyor includes an upstream roller pair disposed upstream of the ejector on the conveyance path, a first downstream roller pair disposed downstream of the ejector on the conveyance path, and a second downstream roller pair disposed downstream of the first downstream roller pair on the conveyance path, the conveyor being configured to convey the recording medium such that respective central positions of the upstream roller pair, the first downstream roller pair, and the second downstream roller pair in a first direction coincide with a central position of the recording medium in the first direction, the first direction being parallel to an axial direction of each of rollers of the upstream roller pair, the first downstream roller pair, and the second downstream roller pair, wherein each of the upstream roller pair, the first downstream roller pair, and the second downstream roller pair includes an upper roller which is to contact a front surface of the recording medium and a lower roller which is to contact a back surface of the recording medium opposite to the front surface, at least one of the upper roller and the lower roller being configured to give a conveyance force to the recording medium while the upper roller and the lower roller nip the recording medium therebetween, so as to convey the recording medium, wherein a rotation speed of the second downstream roller pair is higher than a rotation speed of the first downstream roller pair, and the conveyance force of the first downstream roller pair is larger than the conveyance force of the second downstream roller pair, and wherein the conveyance force of the second downstream roller pair is largest at a position of the second downstream roller pair in the first direction which is nearest to the central position of the second downstream roller pair.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

Overall Structure

Figure 1:
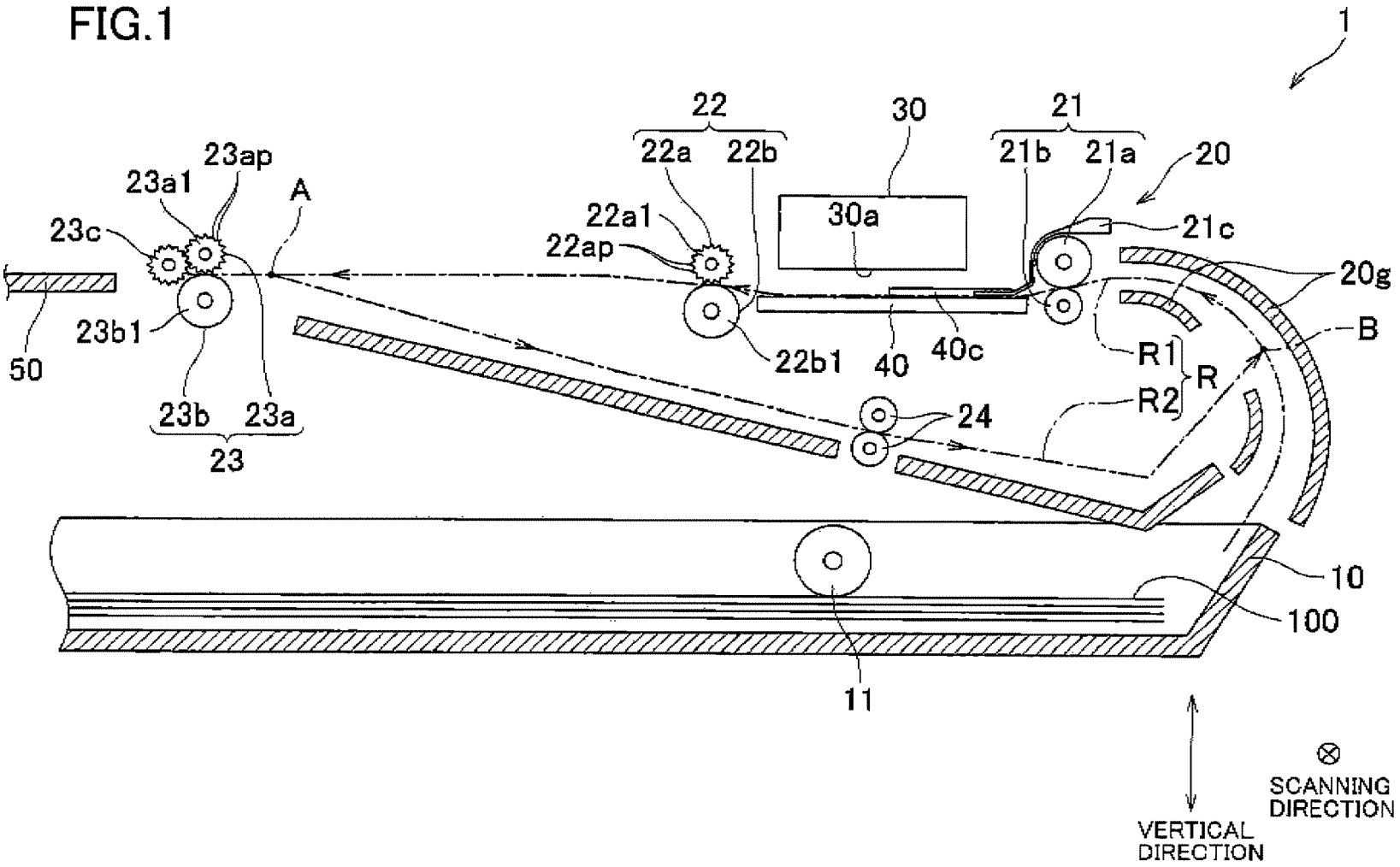
FIG. 1 is a cross-sectional view taken along a plane parallel to a vertical direction, the view showing an inside of a printer according to one embodiment.

As shown in FIG. 1, a printer 1 (as one example of "liquid ejection apparatus") according to one embodiment includes: a sheet supply tray 10 capable of storing a stack of a plurality of sheets 100; a conveyor 20 configured to convey, along a conveyance path R, an uppermost one of the sheets 100 stored in the sheet tray 10; an ejector 30 including a plurality of ejection openings 30*x* (FIG. 2) from which ink is ejected to a front surface of the sheet 100 that is being conveyed by the conveyor 20; a platen 40 opposed to an ejection surface 30*a* of the ejector 30 in which the ejection openings 30*x* are opened; and a sheet discharge tray 50 for receiving the sheet 100 that has been conveyed by the conveyor 20.

Ejector

Figure 2:
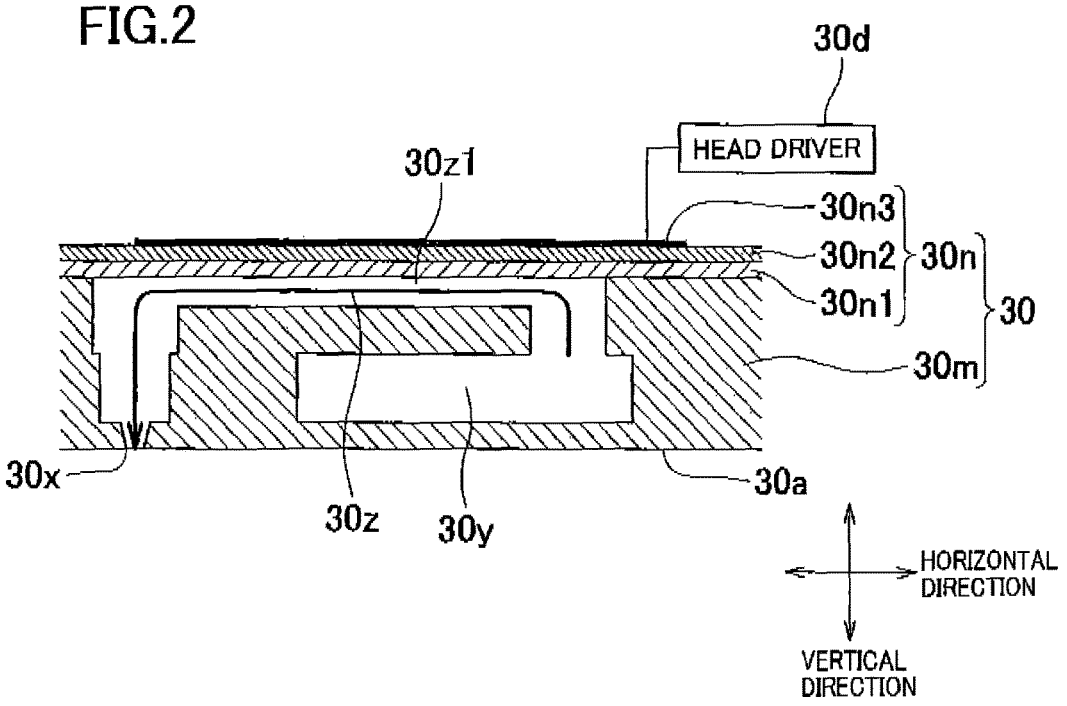
FIG. 2 is a fragmentary sectional view of an ejector of the printer according to the embodiment.

As shown in FIG. 2, the ejector 30 includes a flow-passage unit 30*m* and an actuator unit 30*n*.

A lower surface of the flow-passage unit 30*m* corresponds to the ejection surface 30*a*. There are formed, in the flow-passage unit 30*m*, a common passage 30*y* communicating with an ink tank (not shown) and individual passages 30*z* provided for the respective ejection openings 30*x*. Each individual passage 30*z* is a flow passage extending from an outlet of the common passage 30*y* to a corresponding one of the ejection openings 30*x* via a corresponding one of a plurality of pressure chambers 30*z*1. The pressure chambers 30*z*1 are open in an upper surface of the flow-passage unit 30*m*.

The actuator unit 30*n* includes: an oscillating plate 30*n*1 disposed on the upper surface of the flow-passage unit 30*m* so as to cover the plurality of pressure chambers 30*zl*; a piezoelectric layer 30*n*2 disposed on an upper surface of the oscillating plate 30*n*1; and a plurality of individual electrodes 30*n*3 disposed on an upper surface of the piezoelectric layer 30*n*2 so as to be opposed to the respective pressure chambers 30*z*1. In the oscillating plate 30*n*1 and the piezoelectric layer 30*n*2, a portion sandwiched by and between each individual electrode 30*n*3 and a corresponding one of the pressure chambers 30*z*1 functions as an individual unimorph actuator for the pressure chamber 30*z*1. Each actuator is deformable independently of other actuators in accordance with a voltage applied to the corresponding individual electrode 30*n*3 by a head driver 30*d*. When the actuator is deformed so as to protrude toward the pressure chamber 30*z*1, the volume of the pressure chamber 30*z*1 is decreased, so that a pressure is applied to the ink in the pressure chamber 30*z*1 and the ink is accordingly ejected from the ejection opening 30*x*.

The ejector 30 is of a serial type. The ejector 30 is held by a carriage (not shown) and ejects the ink from the ejection openings 30*x* while reciprocating in a scanning direction.

Conveyance Path

As shown in FIG. 1, the conveyance path R includes: a path R1 extending from the sheet supply tray 10 to the sheet discharge tray 50; and a path R2 connecting a position A located downstream of the ejector 30 on the path R1 and a position B located upstream of the ejector 30 on the path R1.

Conveyor

The conveyor 20 includes: a sheet supply roller 11 disposed so as to be held in contact with an uppermost one of the sheets 100 stored in the sheet supply tray 10; a roller pair 21 (as one example of "upstream roller pair") disposed downstream of the position B on the path R1 and upstream of the ejector 30 on the path R1; a roller pair 22 (as one example of "first roller pair") disposed downstream of the ejector 30 on the path R1 and upstream of the position A on the path R1; a roller pair 23 (as one example of "second roller pair") disposed downstream of the position A on the path R1; a roller pair 24 disposed on the path R2; and guide plates 20*g* that define the conveyance path R. The roller pair 23 is disposed most downstream on the conveyance path R.

When single-sided recording is performed, the sheet 100 is conveyed from the sheet supply tray 10 along the path R1. The ink is ejected to one surface of the sheet (which was facing downward in the sheet supply tray 10) for performing recording. After recording is completed, the sheet 100 is received by the sheet discharge tray 50.

When duplex recording is performed, the sheet 100 is conveyed from the sheet supply tray 10 along the path R1. The ink is ejected to the one surface of the sheet 100 for performing recording on the one surface. After recording on the one surface is completed, conveyance of the sheet 100 is suspended with a trailing end of the sheet 100 nipped by the roller pair 23. Subsequently, the conveyance direction of the sheet 100 is reversed by reverse rotation of the roller pair 23, so that the sheet 100 is conveyed along the path R2 and is returned to the path R1 from the position B. Thereafter, the sheet 100 is conveyed again along the path R1, and the ink is ejected to another surface (which was facing upward in the sheet supply tray 10) for performing recording on another surface. After recording on another surface is completed, the sheet 100 is received by the sheet discharge tray 50.

Each of the roller pairs 21-23 includes an upper roller 21*a*-23*a* that is to contact the front surface of the sheet 100 (which is a surface of the sheet 100 that is opposed to the ejector 30 when the sheet 100 passes between the ejector 30 and the platen 40) and a lower roller 21*b*-23*b* that is to contact a back surface of the sheet 100 opposite to the front surface. The upper roller 21*a*-23*a* and the lower roller 21*b*-23*b* rotate in opposite directions while nipping the sheet 100 therebetween, whereby a conveyance force is given to the sheet 100 so as to convey the sheet 100.

The rotation speeds of the roller pairs 21-23 are set such that the roller pair located more downstream on the path R1 has a higher rotation speed. That is, the rotation speed of the roller pair 23 is higher than the rotation speed of the roller pair 22, and the rotation speed of the roller pair 22 is higher than the rotation speed of the roller pair 21. This configuration stabilizes conveyance of the sheet 100.

The conveyance forces of the roller pairs 21-23 are set such that the roller pair located more upstream on the path R1 has a larger conveyance force. That is, the conveyance force of the roller pair 21 is larger than the conveyance force of the roller pair 22, and the conveyance force of the roller pair 22 is larger than the conveyance force of the roller pair 23. The conveyance force is represented by a product of: a friction coefficient of an outer circumferential surface of each of the upper roller 21*a*-23*a* and the lower roller 21*b*-23*b*; and a nipping force for nipping the sheet 100 by the upper roller 21*a*-23*a* and the lower roller 21*b*-23*b*.

Figure 3:
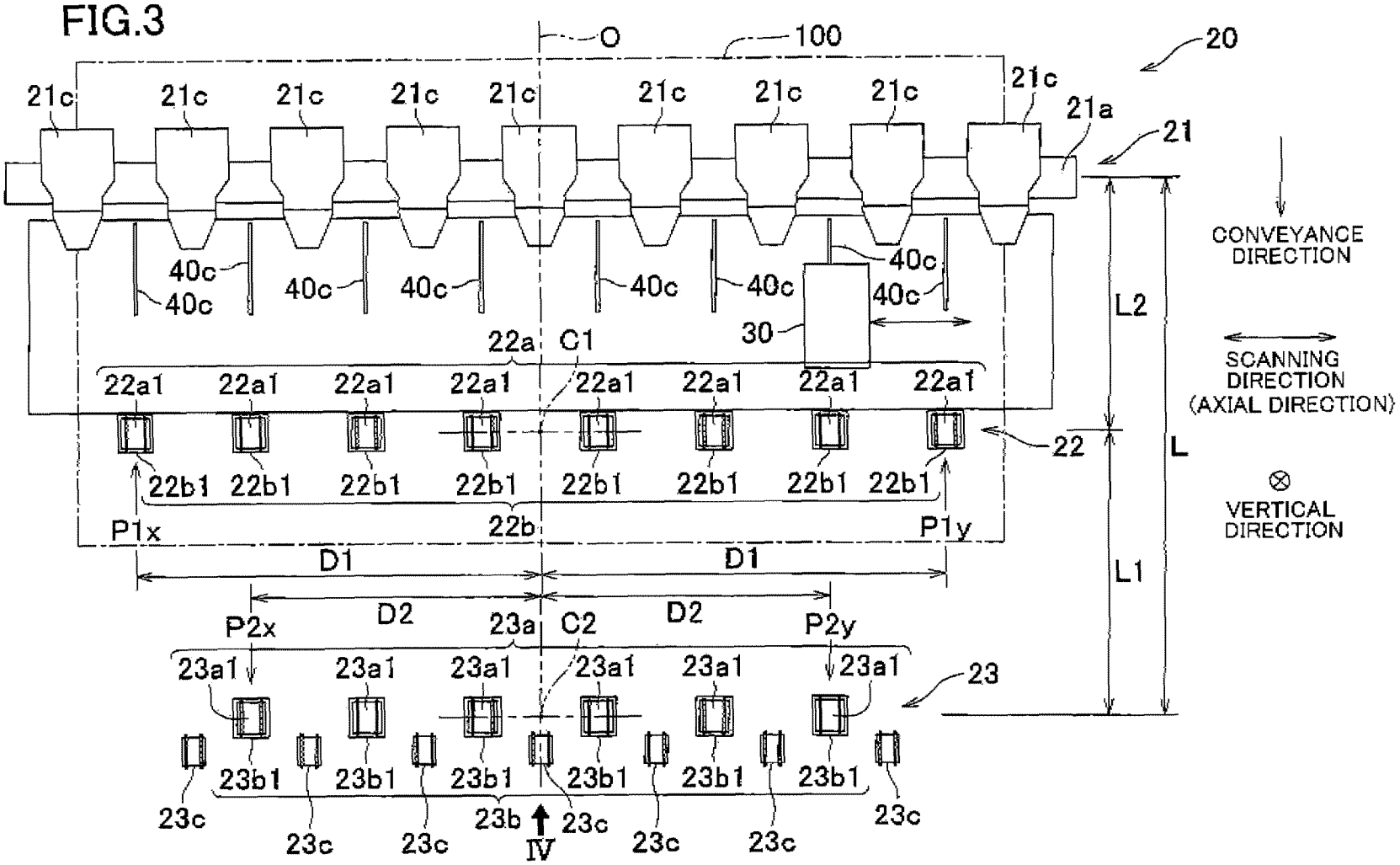
FIG. 3 is a plan view showing roller pairs of a conveyor and the ejector of the printer according to the embodiment.

The conveyor 20 is capable of conveying a plurality of sizes of the sheets 100. As shown in FIG. 3, the conveyor 20 is configured to convey the sheet 100 such that each of centers C0-C2 of the respective roller pairs 21-23 in an axial direction of each of the roller pairs 21-23 (that is parallel to the scanning direction) and a center O of the sheet 100 in its width direction (that is parallel to the axial direction of each of the roller pairs 21-23) coincide with each other. In other words, the conveyor 20 is configured to convey the sheet 100 such that the centers C0-C2 of the roller pairs 21-23 and the center O of the sheet 100 are aligned with each other in the conveyance direction. Here, a direction parallel to the axial direction of each roller pair 21-23 is defined as a first direction. The roller pairs 21-23 are disposed such that the center C0 which is a central position of the roller pair 21 in the first direction, the center C1 which is a central position of the roller pair 22 in the first direction, and the center C2 which is a central position of the roller pair 23 in the first direction are aligned with one another in the conveyance direction. The conveyor 20 and the conveyance path R are designed such that the sheet 100 is conveyed in a state in which the center O as the central position of the sheet 100 in the first direction coincides with positions in the first direction corresponding to the respective centers C0, C1, C2. In other words, the conveyor 20, the conveyance path R, and the roller pairs 21-23 are designed such that all of the centers C0, C1, C2 of the roller pairs 21-23 and the center O of the sheet 100 are located on one plane that is perpendicular to the first direction. In FIG. 3, shafts that support the respective roller pairs 21-23 are not illustrated.

A distance L between the roller pair 21 and the roller pair 23 along the conveyance path R is equal to or smaller than a length, along the conveyance path R, of the sheet 100 having a certain size that is most frequently used (e.g., A4 size or a letter size) among a plurality of sizes of the sheets 100 that can be conveyed by the conveyor 20.

Each of the upper roller 21*a* and the lower roller 21*b* of the roller pair 21 is constituted by one long roller extending in the axial direction. Each of the upper roller 22*a*, 23*a* and the lower roller 22*b*, 23*b* of each roller pair 22, 23 is constituted by a plurality of partial rollers spaced apart from one another in the axial direction.

The roller pair 22 includes eight pairs of partial rollers 22*a*1, 22*b*1. The partial rollers 22*a*1, 22*b*1 of each pair are disposed so as to be in contact with each other. (The partial roller 22*a*1 is one example of "first partial roller".) The roller pair 23 includes six pairs of partial rollers 23*a*1, 23*b*1. The partial rollers 23*a*1, 23*b*1 of each pair are disposed so as to be in contact with each other. (The partial roller 23*a*1 is one example of "second partial roller".) The eight pairs of the partial rollers 22*a*1, 22*b*1 are arranged in the scanning direction so as to be equally spaced apart from one another. The six pairs of the partial rollers 23*a*1, 23*b*1 are arranged in the scanning direction so as to be equally spaced apart from one another. Positions of the six pairs of the partial rollers 23*a*1, 23*b*1 in the scanning direction respectively correspond to positions, in the scanning direction, of six of the eight pairs of the partial rollers 22*a*1, 22*b*1 except two outermost pairs of the partial rollers 22*a*1, 22*b*1 in the scanning direction. Position P1*x*, P1*y* at which the two outermost pairs of the partial rollers 22*a*1, 22*b*1 of the roller pair 22 in the scanning direction are respectively disposed are distant from the center C1 in the scanning direction by the same distance D1. (Each of the positions P1*x*, P1*y* is one example of "first outermost position".) Positions P2*x*, P2*y* at which two outermost pairs of the partial rollers 23*a*1, 23*b*1 of the roller pair 23 in the scanning direction are respectively disposed are distant from the center C2 in the scanning direction by the same distance D2. (Each of the positions P2*x*, P2*y* is one example of "second outermost position".) The position P2*x* is nearer to the centers C1, C2 than the position P1*x* in the scanning direction, and the position P2*y* is nearer to the centers C1, C2 than the position P1*y* in the scanning direction (D1>D2).

As shown in FIG. 1, each of the partial rollers 22*b*1 of the lower roller 22*b* is a rubber roller having no protrusions on its outer circumferential surface, and each of the partial rollers 23*b*1 of the lower roller 23*b* is a rubber roller having no protrusions on its outer circumferential surface. Each of the partial rollers 22*a*1 of the upper roller 22*a* is a spur roller having at least one protrusion 22*ap* on its outer circumferential surface, and each of the partial rollers 23*a*1 of the upper roller 23*a* is a spur roller having at least one protrusion 23*ap* on its outer circumferential surface.

Configuration for Forming the Sheet into Corrugated Shape

For forming the sheet 100 into a corrugated or wavy shape along the scanning direction, nine corrugating plates 21*c* are provided over the upper roller 21*a* of the roller pair 21, eight ribs 40*c* are provided on a front surface of the platen 40 (that is opposed to the ejector 30), and seven corrugating spurs 23*c* are provided immediately downstream of the roller pair 23 on the path R1, as shown in FIGS. 1 and 3. By forming the sheet 100 into the corrugated or wavy shape along the scanning direction, resilience is given to the sheet 100, so that the sheet 100 can be appropriately conveyed.

As shown in FIG. 3, the nine corrugating plates 21*c* are arranged in the scanning direction so as to be equally spaced apart from one another. As shown in FIG. 1, each corrugating plate 21*c* extends from above the upper roller 21*a* toward the downstream side on the path R1 and is opposed at its distal end portion to the front surface of the platen 40 with a slight clearance interposed therebetween.

As shown in FIG. 3, the eight ribs 40*c* are arranged so as to be equally spaced apart from one another in the scanning direction. Each of the ribs 40*c* is disposed between corresponding two of the nine corrugating plates 21*c* that are adjacent to each other in the scanning direction. Each rib 40*c* extends in the conveyance direction. Positions of the eight ribs 40*c* in the scanning direction and positions of the eight pairs of the partial rollers 22*a*1, 22*b*1 in the scanning direction are the same.

A distal end portion of each rib 40*c* is located at a height level higher than the distal end portion of each corrugating plate 21*c*. With this positional relationship, the distal end portions of the eight ribs 40*c* support the sheet 100 from below while the distal end portions of the nine corrugating plates 21*c* press the sheet 100 from above, whereby the sheet 100 is formed into the corrugated or wavy shape along the scanning direction.

The seven corrugating spurs 23*c* are arranged so as to be equally spaced apart from one another in the scanning direction. Positions of the seven corrugating spurs 23*c* in the scanning direction are the same as positions, in the scanning direction, of seven of the nine corrugating plates 21*c* except two outermost corrugating plates 21*c*. Each of the six pairs of the partial rollers 23*a*1, 23*b*1 is disposed between corresponding two of the seven corrugating spurs 23*c* that are adjacent to each other in the scanning direction.

Figure 4:
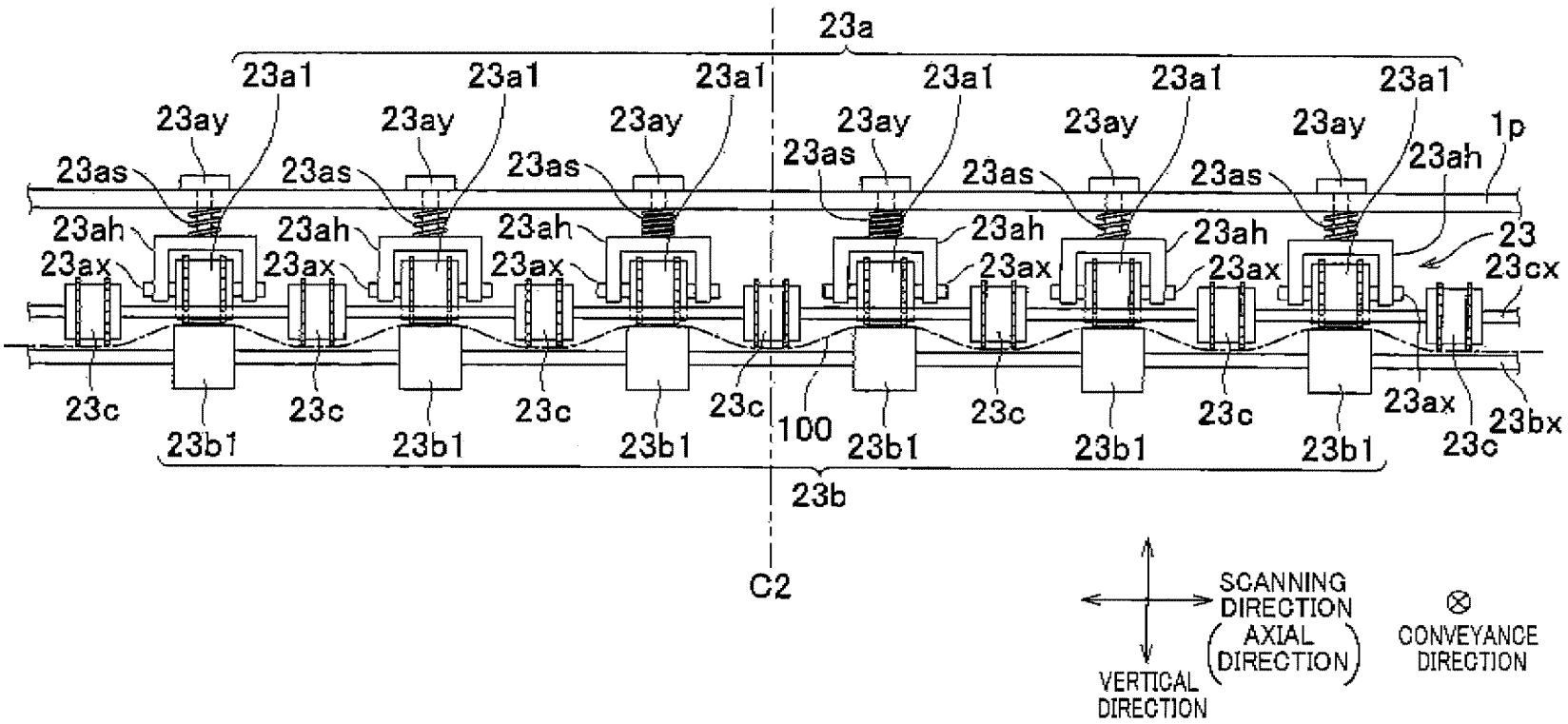
FIG. 4 is a view seen in a direction indicated by an arrow IV in FIG. 3.

As shown in FIG. 4, a contact point of the partial rollers 23*a*1, 23*b*1 of each pair, namely, a point of nipping the sheet 100, is located at a height level higher than a lower end of each corrugating spur 23*c*. With this positional relationship, the six partial rollers 23*b*1 support the sheet 100 from below while the seven corrugating spurs 23*c* press the sheet 100 from above, whereby the sheet 100 is formed into the corrugated or wavy shape along the scanning direction. As described above, each of the seven corrugating spurs 23*c* is disposed between corresponding two of the six pairs of the partial rollers 23*a*1, 23*b*1. Thus, the roller pair 23 has a function of forming the sheet 100 into the corrugated or wavy shape along the scanning direction.

A force by which the corrugating spurs 23*c* press the sheet 100 is smaller than a force by which the corrugating plates 21*c* press the sheet 100. The conveyance force could be generated at portions corresponding to the corrugating plates 21*c* and the corrugating spurs 23*c*. Each of the corrugating plates 21*c* and the corrugating spurs 23*c* are, however, not configured to cooperate with another member disposed thereunder to nip the sheet 100 therebetween. Therefore, the conveyance force indicated above may be ignored.

Structure for Supporting Each Roller

The seven corrugating spurs 23*c* are fixed to one long shaft 23*cx* extending in the scanning direction. The six partial rollers 23*b*1 of the lower roller 23*b* are fixed to one long shaft 23*bx* extending in the scanning direction. The shafts 23*bx*, 23*cx* are rotatably supported by a housing (not shown) of the printer 1.

The six partial rollers 23*a*1 of the upper roller 23*a* are respectively fixed to six short shafts 23*ax* extending in the scanning direction. Each shaft 23*ax* is rotatably supported by a holder 23*ah*. A protruding portion 23*ay* is provided on an upper surface of each holder 23*ah* so as to protrude upward from the upper surface. Each protruding portion 23*ay* passes through a corresponding through-hole formed in a plate 1*p*. The protruding portion 23*ay* includes a lower part that is located below the plate 1*p* and an upper part that is located above the plate 1*p*. The plate 1*p* is fixed to the housing of the printer 1. A spring 23*as* (as one example of "biasing member") is wound around the lower part of each protruding portion 23*ay*, and each holder 23*ah* is biased downward by a biasing force of the corresponding spring 23*as*. That is, the spring 23*as* applies, to the corresponding partial roller 23*al* of the upper roller 23*a*, the biasing force in a direction toward the corresponding partial roller 23*b*1 of the lower roller 23*b*.

The biasing forces of the six springs 23*as* are set such that the spring 23*as* located nearer to the center C2 in the scanning direction has a larger biasing force. That is, two of the six springs 23*as* located nearest to the center C2 in the scanning direction (each as one example of "centrally located one of the plurality of biasing members") have the largest biasing force (biasing force="large"), two of the six springs 23*as* located farthest from the center C2 in the scanning direction (i.e., two outermost springs 23*as* in the scanning direction) have the smallest biasing force (biasing force="small"), and two of the six springs 23*as* each of which is the second outermost in the scanning direction, namely, each of which is interposed between the spring 23*as* whose biasing force is "large" and the spring 23*as* whose biasing force is "small", have the biasing force "medium". Further, two of the six partial rollers 23*a*1 which are located nearest to the center C2 in the scanning direction (each as one example of "centrally located one of the plurality of second partial rollers") have a friction coefficient on outer circumferential surfaces thereof larger than that of other partial rollers 23*a*I. The friction coefficient of the two partial rollers 23*a*1 is made different from that of other partial rollers 23*a*1 by changing a material for forming the outer circumferential surfaces of the two partial rollers 23*a*1 or by changing processing applied to the outer circumferential surfaces of the two partial rollers 23*a*1. Owing to the difference in the biasing force among the springs 23*as* and the difference in the friction coefficient of the outer circumferential surface among the partial rollers 23*a*1, the conveyance force of the roller pair 23 is not constant in the axial direction. Specifically, the conveyance force of the roller pair 23 is largest at a position located nearest to the center C2 and is smallest at positions located farthest from the center C2.

While not shown, the eight partial rollers 22*b*1 of the lower roller 22*b* of the roller pair 22 are fixed to one long shaft which extends in the scanning direction and which is rotatably supported by the housing of the printer 1, like the six partial rollers 23*b*1 of the lower roller 23*b* of the roller pair 23. Like the six partial rollers 23*a*1 of the upper roller 23*a* of the roller pair 23, the eight partial rollers 22*a*1 of the upper roller 22*a* of the roller pair 22 are respectively fixed to eight short shafts which extend in the scanning direction and which are supported, through respective holders, by a plate that is fixed to the housing of the printer 1. Each partial roller 22*a*1 is biased downward by a biasing force of a spring, i.e., in a direction toward the corresponding partial roller 22*b*1. The biasing forces of the springs respectively provided for the eight partial rollers 22*a*1 are substantially the same.

The upper roller 21*a* and the lower roller 21*b* of the roller pair 21 are respectively fixed to long shafts which extend in the scanning direction and which are rotatably supported by the housing of the printer 1.

Relationship Between Conveyance Force and Moment

The printer 1 having the roller pairs 21-23 constructed and disposed as described above is designed so as to satisfy the following expressions (1)-(4). (Refer to FIGS. 4 and 5.)

$$|M1|>|M2| \tag{1}$$

$$|M1|/L1<\int F2(l)\cdot dl \tag{2}$$

$$|M0|>|M1| \tag{3}$$

$$|M0|/L2<\int F1(l)\cdot dl \tag{4}$$

Figure 5:
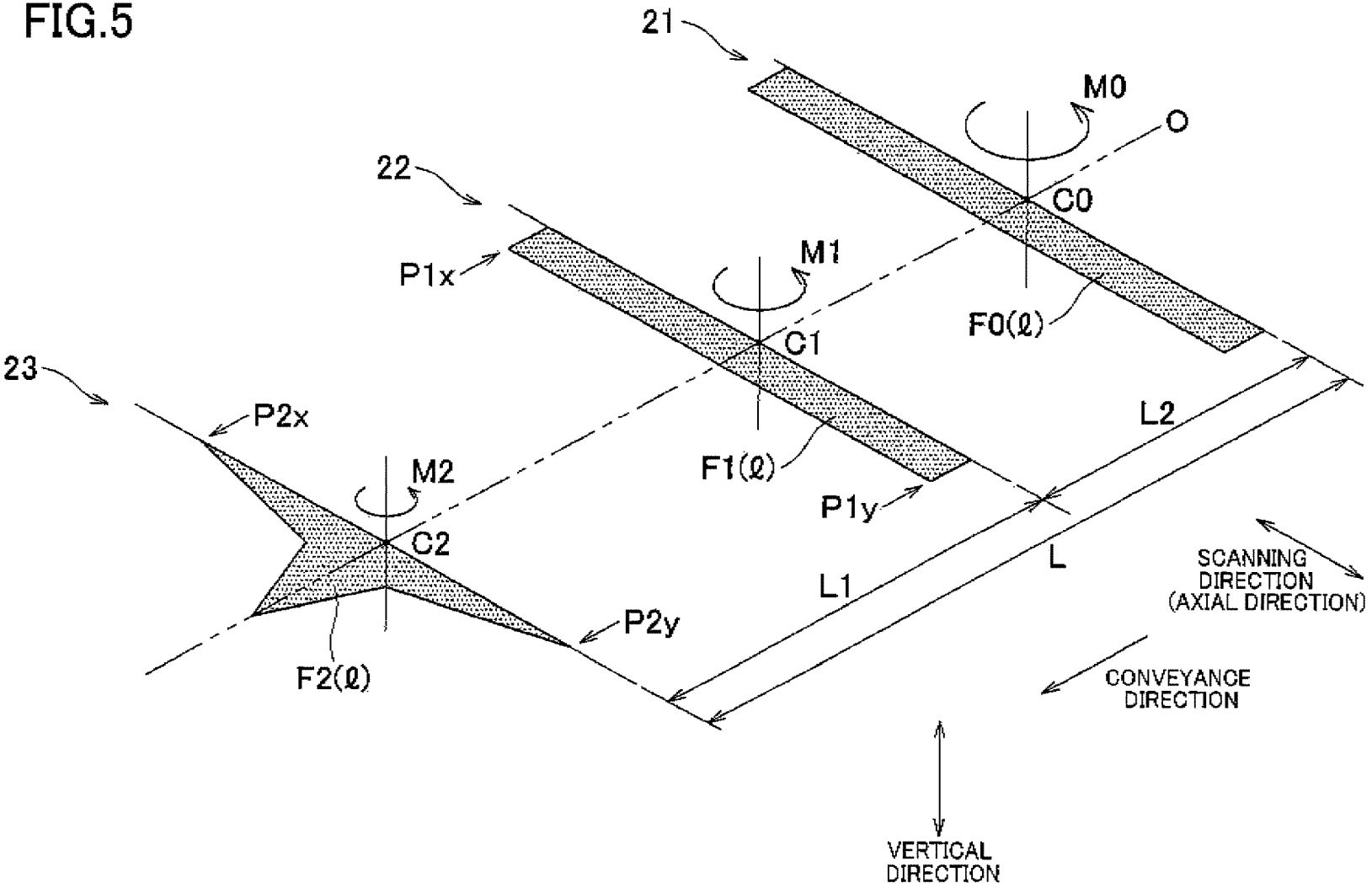
FIG. 5 is a schematic view showing a relationship between conveyance force of each roller pair and moment.

In the above expressions, M1 represents moment about an axis passing the center C1 and extending in parallel with the vertical direction, which moment is generated by a variation in a conveyance force F1 of the roller pair 22 in the axial direction of the roller pair 22 (i.e., a first direction parallel to the scanning direction). M2 represents moment about an axis passing the center C2 and extending in parallel with the vertical direction, which moment is generated by a variation in a conveyance force F2 of the roller pair 23 in the axial direction of the roller pair 23 (i.e., the first direction parallel to the scanning direction). L1 represents a distance between the roller pair 22 and the roller pair 23 along the path R1, F2(*l*) represents the conveyance force at each of a plurality of positions l in the axial direction of the roller pair 23. M0 represents moment about an axis passing the center C0 and extending in the vertical direction, which moment is generated by a variation in a conveyance force F0 of the roller pair 21 in the axial direction of the roller pair 21 (i.e., the first direction parallel to the scanning direction). L2 is a distance between the roller pair 21 and the roller pair 22 along the path R1. F1(*l*) is the conveyance force at each of a plurality of positions l of the roller pair 22 in the axial direction. In FIG. 5, F0(*l*) represents the conveyance force at each of a plurality of positions 1 of the roller pair 21 in the axial direction.

In the present embodiment, each of the roller pairs 22, 23 is constituted by the plurality of partial rollers spaced apart from one another in the axial direction. Thus, the above expressions (2) and (4) can be respectively replaced with the following expressions (2') and (4'):

$$|M1|/L1<\Sigma F2' \quad (2')$$

$$|M0|/L2<\Sigma F1' \quad (4')$$

In the above expressions, F2' represents a conveyance force of each partial roller of the roller pair 23, and F1' represents a conveyance force of each partial roller of the roller pair 22.

As described above, in the present embodiment, the rotation speed of the roller pair 23 is higher than the rotation speed of the roller pair 22, and the conveyance force of the roller pair 22 is larger than the conveyance force of the roller pair 23. Under the conditions, the conveyance force F2 of the roller pair 23 is not made constant in the axial direction but is made largest at the position located nearest to the center C2. This configuration enables stable conveyance of the sheet 100 and prevents skewing of the sheet 100 when the sheet 100 is conveyed by the roller pairs 22, 23 whose upper rollers are constituted by the spur rollers. Specifically, the conveyance force F2 of the roller pair 23 is made largest at the position located nearest to the center C2 in the axial direction, instead of making the conveyance force F2 constant in the axial direction. With this configuration, the conveyance force F1 of the roller pair 22 can be made sufficiently larger than the conveyance force F2 of the roller pair 23 without increasing the conveyance force F1 of the roller pair 22 too much or without decreasing the conveyance force F2 of the roller pair 23 too much. Thus, it is possible to avoid a damage of the sheet 100 due to pressing by the protrusions 22*ap* which would be caused if the conveyance force F1 of the roller pair 22 were excessively increased or it is possible to avoid a failure in conveyance due to slippage of the sheet 100 which would be caused when the sheet 100 is conveyed only by the roller pair 23 if the conveyance force F2 of the roller pair 23 were excessively decreased. The present embodiment therefore enables the sheet 100 to be conveyed with high stability and prevents the sheet 100 form skewing.

The distance L between the roller pair 21 and the roller pair 23 along the conveyance path R is equal to or smaller than a length, along the conveyance path R, of the sheet 100 having a certain size among the plurality of sizes of the sheets 100 that can be conveyed by the conveyor 20 (FIG. 3), e.g., the most frequently used size such as an A4 size or a letter size. In conveying the sheet 100 having such a size, the sheet 100 is nipped by the roller pair 23 before the trailing end of the sheet 100 passes through the roller pair 21, thereby avoiding the sheet 100 from being conveyed only by the roller pair 22. Thus, it is possible to obviate the problem caused when the sheet 100 is conveyed only by the roller pair 22, i.e., the problem of unstable posture of the sheet 100.

The upper roller 22*a* of the roller pair 22 includes the eight partial rollers 22*al* (FIG. 3) spaced apart from one another in the axial direction. In this case, although the ink landed on the front surface of the sheet 100 is prevented from being transferred to the upper roller 22*a* with higher reliability, fluctuations are likely to be generated in the friction coefficients of the outer circumferential surfaces of the eight partial rollers 22*al* and in the pressing forces with respect to the lower roller 22*b* due to manufacturing error of the partial rollers 22*a*1 and provision of the springs for the respective partial rollers 22*a*1. Accordingly, the conveyance force F1 of the roller pair 22 tends to vary in the axial direction, and skewing of the sheet 100 may occur due to unstable conveyance when the sheet 100 is conveyed by the roller pairs 22, 23. In the present printer 1 constructed as described above, however, the sheet 100 can be conveyed with high stability so as to prevent skewing of the sheet 100.

The upper roller 23*a* of the roller pair 23 includes the six partial rollers 23*al* (FIG. 3) spaced apart from one another in the axial direction. This configuration makes it possible to easily change the conveyance force F2 of the roller pair 23 in the axial direction by adjusting the structure of each of the partial rollers 23*al* and the biasing force of each of the springs 23*as* provided for the respective partial rollers 23*al*. This configuration thus enables, with ease, the conveyance force F2 of the roller pair 23 to be the largest at the position located nearest to the center C2.

The friction coefficient of the outer circumferential surfaces of the two of the six partial rollers 23*a*1 disposed nearest to the center C2 in the axial direction is larger than the friction coefficients of the outer circumferential surfaces of the other partial rollers 23*al*. This configuration enables, with ease, the conveyance force F2 of the roller pair 23 to be the largest at the position located nearest to the center C2 of the axial direction, by adjusting the friction coefficients of the outer circumferential surfaces of the partial rollers 23*a*1.

As shown in FIG. 4, the biasing force of the two of the six springs 23*as* provided for the respective two partial rollers 23*a*1 disposed nearest to the center C2 in the axial direction is larger than that of the other springs 23*as*. This configuration enables, with ease, the conveyance force F2 of the roller pair 23 to be the largest at the position located nearest to the center C2, by adjusting the biasing forces of the springs 23*as*.

The printer l is designed to satisfy the expressions (1) and (2) described above. This configuration more reliably prevents skewing of the sheet 100 when the sheet 100 is conveyed by the roller pairs 22, 23 whose upper rollers are the spur rollers.

The printer 1 is designed to satisfy the expressions (3) and (4) described above. This configuration prevents skewing of the sheet 100 also when the sheet 100 is conveyed by the roller pairs 21, 22.

The rotation speed of the roller pair 22 is higher than the rotation speed of the roller pair 21, and the conveyance force of the roller pair 21 is larger than the conveyance force of the roller pair 22. This configuration makes it possible to convey the sheet 100 with high stability when the sheet 100 is conveyed by the roller pairs 21, 22.

The roller pair 23 is disposed most downstream on the conveyance path R as shown in FIG. 1. With this configuration, even if the sheet 100 skews when being conveyed only by the roller pair 23, it is possible to prevent or reduce a trouble that arises from skewing, such as jamming of the sheet 100.

The roller pair 23 has a function of forming the sheet 100 into the corrugated or wavy shape along the scanning direction. From the viewpoint of forming the sheet 100 into the corrugated or wavy shape over the entire width of the sheet 100, it is preferable to dispose the roller pair 23 over the entire width of the sheet 100. In such a configuration, the conveyance force of the roller pair 23 is made largest at the position located nearest to the center C2 in the axial direction, instead of making the conveyance force constant in the axial direction, whereby the sheet 100 is stably conveyed and is accordingly prevented from skewing when the sheet 100 is conveyed by the roller pairs 22, 23 whose upper rollers are the spur rollers.

The second outermost positions (the positions P2$x$, P2$y$) which are the farthest from the center C2 of the roller pair 23 in the axial direction are nearer to the centers C1, C2 (FIG. 3) than the first outermost positions (the positions P1$x$, P1$y$) which are the farthest from the center C1 of the roller pair 22 in the axial direction (D2<D1). This configuration is more likely to satisfy conditions for stabilizing conveyance of the sheet 100 and thereby preventing skewing of the sheet 100 when the sheet 100 is conveyed by the roller pairs 22, 23 whose upper rollers are the spur rollers.

The conveyance force F2 of the roller pair 23 is smallest at positions of the roller pair 23 in the axial direction which are located farthest from the center C2, as shown in FIGS. 4 and 5. In this configuration, the conveyance force F2 of the roller pair 23 is made largest at the position located nearest to the center C2 and is made smallest at the positions located farthest from the center C2, so that it is possible to stabilize conveyance of the sheet 100 and to thereby prevent skewing of the sheet 100 with higher reliability when the sheet 100 is conveyed by the roller pairs 22, 23 whose upper rollers are the spur rollers.

While the embodiment of the disclosure has been described above, it is to be understood that the disclosure is not limited to the details of the illustrated embodiment, but may be embodied with other various changes and modifications, which may occur to those skilled in the art, without departing from the scope of the disclosure defined in the attached claims.

Modifications

The upper roller and the lower roller of the first downstream roller pair do not necessarily have to be constituted by the plurality of partial rollers, but may be constituted by one long roller extending in the axial direction. Similarly, the upper roller and the lower roller of the second downstream roller pair do not necessarily have to be constituted by the plurality of partial rollers, but may be constituted by one long roller extending in the axial direction. Also in such cases, the friction coefficients and the biasing forces of the springs fluctuate in the axial direction, and the conveyance force may vary in the axial direction.

The conveyance force of the second downstream roller pair in the axial direction does not necessarily have to be adjusted by adjusting both of the biasing forces of the biasing members provided for the respective partial rollers and the friction coefficients of the outer circumferential surfaces of the partial rollers, but may be adjusted by adjusting only one of the biasing forces and the friction coefficients.

The second downstream roller pair does not necessarily have to be disposed most downstream on the conveyance path. The second downstream roller pair does not necessarily have to have the function of forming the recording medium into the corrugated or wavy shape along the axial direction. (The corrugating spurs 23$c$ in the illustrated embodiment may be omitted.) A position of each first outermost position in the axial direction and a position of each second outermost position in the axial direction may be the same (D1=D2).

The ejector is not limited to the serial type but may be a line type. The liquid ejected by the ejector is not limited to the ink but may be any liquid (such as a treatment liquid for causing coagulation or precipitation of a component in the ink). The recording medium is not limited to the sheet but may be any recordable medium such as a cloth. The present disclosure is applicable not only to the printer but also to a facsimile, a copying machine, a multi-function peripheral (MFP) and the like.

What is claimed is:

1. A liquid ejection apparatus, comprising:

a conveyor configured to convey a recording medium along a conveyance path; and an ejector including a plurality of ejection openings from which a liquid is ejected to a front surface of the recording medium conveyed by the conveyor;

wherein the conveyor includes an upstream roller pair disposed upstream of the ejector on the conveyance path, a first downstream roller pair disposed downstream of the ejector on the conveyance path, and a second downstream roller pair disposed downstream of the first downstream roller pair on the conveyance path, the conveyor being configured to convey the recording medium such that respective central positions of the upstream roller pair, the first downstream roller pair, and the second downstream roller pair in a first direction coincide with a central position of the recording medium in the first direction, the first direction being parallel to an axial direction of each of rollers of the upstream roller pair, the first downstream roller pair, and the second downstream roller pair, wherein each of the upstream roller pair, the first downstream roller pair, and the second downstream roller pair includes an upper roller which is to contact a front surface of the recording medium and a lower roller which is to contact a back surface of the recording medium opposite to the front surface, at least one of the upper roller and the lower roller being configured to give a conveyance force to the recording medium while the upper roller and the lower roller nip the recording medium therebetween, so as to convey the recording medium, wherein a rotation speed of the second downstream roller pair is higher than a rotation speed of the first downstream roller pair, and the conveyance force of the first downstream roller pair is larger than the conveyance force of the second downstream roller pair, and wherein the conveyance force of the second downstream roller pair is largest at a position of the second downstream roller pair in the first direction which is nearest to the central position of the second downstream roller pair.

2. The liquid ejection apparatus according to claim 1, wherein the conveyance force of the second downstream roller pair is different at a plurality positions of the second downstream roller pair in the first direction.

3. The liquid ejection apparatus according to claim 1, wherein the upper roller of each of the first downstream roller pair and the second downstream roller pair is a spur roller including at least one protrusion formed on its outer circumferential surface.

4. The liquid ejection apparatus according to claim 1, wherein the conveyor is configured to convey recording media of a plurality of sizes each as a the recording medium, and wherein a distance between the upstream roller pair and the second downstream roller pair along the conveyance path is equal to or smaller than a length, along the conveyance path, of the recording medium of a certain one of the plurality of sizes.

5. The liquid ejection apparatus according to claim 1, wherein the upper roller of the first downstream roller pair includes a plurality of first partial rollers spaced apart from each other in the first direction.

6. The liquid ejection apparatus according to claim 1, wherein the upper roller of the second downstream roller pair includes a plurality of second partial rollers spaced apart from each other in the first direction.

7. The liquid ejection apparatus according to claim 6, wherein a friction coefficient of an outer circumferential surface of a centrally located one of the plurality of second partial rollers is larger than a friction coefficient of an outer circumferential surface of each of the second partial rollers other than the centrally located one of the plurality of second partial rollers, the centrally located one of the plurality of second partial rollers being located nearest to the central position of the second downstream roller pair in the first direction.

8. The liquid ejection apparatus according to claim 6, wherein the plurality of second partial rollers are respectively provided with a plurality of biasing members each of which is configured to give a biasing force that acts in a direction toward the lower roller, and wherein a biasing force of a centrally located one of the plurality of biasing members is larger than a biasing force of each of the biasing members other than the centrally located one of the plurality of biasing members, the centrally located one of the plurality of biasing members being located nearest to the central position of the second downstream roller pair in the first direction.

9. The liquid ejection apparatus according to claim 1, wherein, where M1 is defined as moment about an axis passing the central position of the first downstream roller pair in the first direction and extending in parallel with a vertical direction, the moment being generated by a variation in the conveyance force of the first downstream roller pair in the first direction, M2 is defined as moment about an axis passing the central position of the second downstream roller pair in the first direction and extending in parallel with the vertical direction, the moment being generated by a variation in the conveyance force of the second downstream roller pair in the first direction, L1 is defined as a distance between the first downstream roller pair and the second downstream roller pair along the conveyance path, and F2(*l*) is defined as the conveyance force at each of a plurality of positions of the second downstream roller pair in the first direction, the following expressions are satisfied: $|M1|>|M2|$, $|M1|/L1<\int F2(l)dl$.

10. The liquid ejection apparatus according to claim 9, wherein, where M0 is defined as moment about an axis passing the central position of the upstream roller pair in the first direction and extending in parallel with the vertical direction, the moment being generated by a variation in the conveyance force of the upstream roller pair in the first direction, L2 is defined as a distance between the upstream roller pair and the first downstream roller pair along the conveyance path, and F1(*l*) is defined as the conveyance force at each of a plurality of positions of the first downstream roller pair in the first direction, the following expressions are satisfied: $|M0|>|M1|$, $|M0|/L2<\int F1(l)dl$.

11. The liquid ejection apparatus according to claim 1, wherein the rotation speed of the first downstream roller pair is higher than a rotation speed of the upstream roller pair, and the conveyance force of the upstream roller pair is larger than the conveyance force of the first downstream roller pair.

12. The liquid ejection apparatus according to claim 1, wherein the second downstream roller pair is located most downstream on the conveyance path.

13. The liquid ejection apparatus according to claim 1, wherein the second downstream roller pair has a function of forming the recording medium into a corrugated shape along the first direction.

14. The liquid ejection apparatus according to claim 1, wherein a second outermost position is nearer to the central position in the first direction than a first outermost position, the first outermost position being the farthest position from the central position of the first downstream roller pair in the first direction, the second outermost position being the farthest position from the central position of the second downstream roller pair in the first direction.

15. The liquid ejection apparatus according to claim 1, wherein the conveyance force of the second downstream roller pair is smallest at a position of the second downstream roller pair in the first direction which is farthest from the central position of the second downstream roller pair in the first direction.

* * * * *